US005908214A

United States Patent [19]

Dinardo

[11] Patent Number: 5,908,214

[45] Date of Patent: Jun. 1, 1999

[54] HANDLE CONSTRUCTION FOR GOLF BALL RETRIEVER

[75] Inventor: Frank L. Dinardo, deceased, late of Mt. Prospect, Ill., by Irene A. Dinardo, legal representative

[73] Assignee: Pro Line Retrievers, Inc., Longwood, Fla.

[21] Appl. No.: 09/060,514

[22] Filed: Apr. 14, 1998

[51] Int. Cl.[6] ..... A63B 47/02; F16B 7/14

[52] U.S. Cl. ..... 294/19.2; 403/109

[58] Field of Search ..... 294/19.1, 19.2, 294/57; 15/144.4; 16/115; 403/104, 109, 377; 473/286, 296

[56] References Cited

U.S. PATENT DOCUMENTS

| | | | |
|---|---|---|---|
| 4,508,467 | 4/1985 | Choffin . | |
| 4,659,125 | 4/1987 | Chuan . | |
| 4,728,134 | 3/1988 | Allen | 294/19.2 |
| 5,188,409 | 2/1993 | Forev . | |
| 5,265,926 | 11/1993 | DiNardo . | |
| 5,375,938 | 12/1994 | Bartlow . | |
| 5,423,584 | 6/1995 | Pasternak | 294/19.2 |
| 5,549,407 | 8/1996 | Levi et al. . | |
| 5,579,557 | 12/1996 | Boden . | |
| 5,586,628 | 12/1996 | Wang . | |
| 5,692,856 | 12/1997 | Newman, Jr. et al. . | |

*Primary Examiner*—Johnny D. Cherry
*Attorney, Agent, or Firm*—James H. Beusse; Holland & Knight LLP

[57] ABSTRACT

A holding mechanism for a telescopic handle comprising a plurality of telescoping hollow tubes characterized by relative sliding stiffness between each of the tubes and having a similar resistance to rotation comprises a one piece partial sleeve sized to fit snugly about a respective one of the telescoping tubes and having a crimped portion extending radially inward over an axial extent of the sleeve intermediate its opposite circumferential ends. Each tube has an axially extending slot adjacent a first end for receiving the crimped portion of the sleeve when the sleeve is positioned on the tube. The handle is assembled by sliding another tube over the tube and sleeve. The overlaying tube has one end terminating in a necked down portion having an inner diameter larger than an outer diameter of the inner tube and smaller than a diameter of the sleeve when the sleeve is positioned on the inner tube whereby the one end of the outer tube cannot pass over the sleeve on the inner tube.

4 Claims, 1 Drawing Sheet

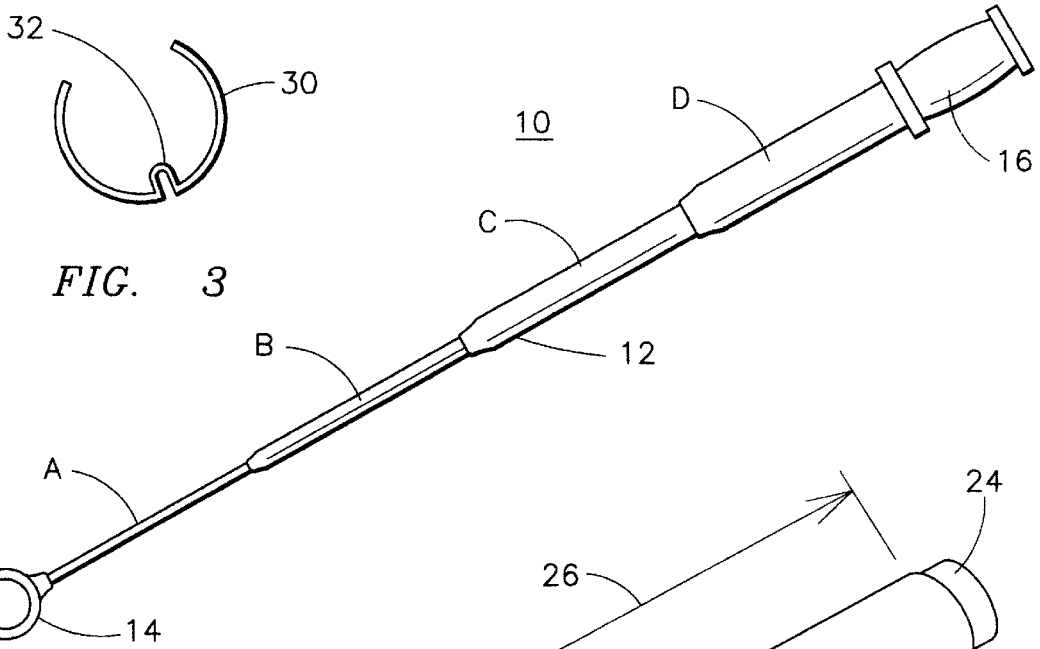
FIG. 3
FIG. 1
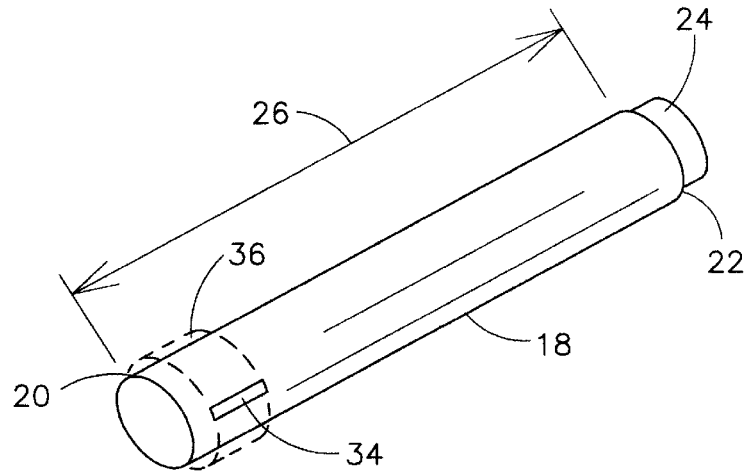
FIG. 2
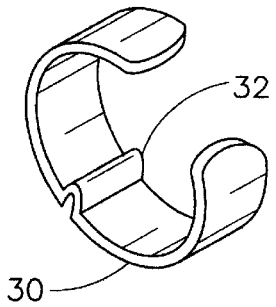
FIG. 4
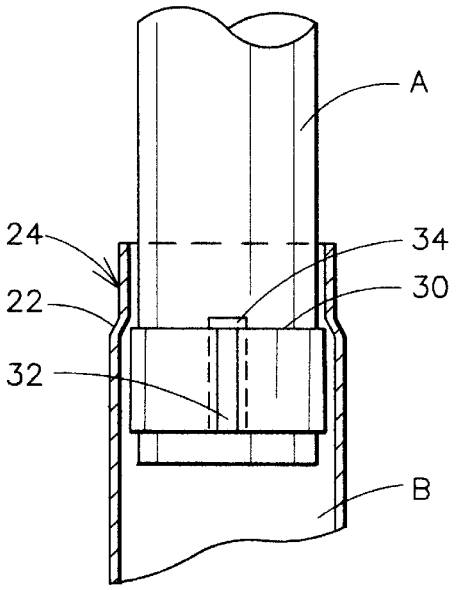
FIG. 5

HANDLE CONSTRUCTION FOR GOLF BALL RETRIEVER

BACKGROUND OF THE INVENTION

The present invention relates to golf ball retrievers and, more particularly, to a handle construction for such retrievers.

Golf ball retrievers are well known devices generally constructed of a telescoping handle with a ball trapping or pick-up element attached to an end of the end section of the handle. An exemplary form of such a retriever is shown in U.S. Pat. No. 5,265,926 of Frank L. DiNardo. The telescopic handle of such retrievers is formed of a plurality of sections and may be extendable from a collapsed length of about 3 feet to an extended length of about 18 feet. However, there are also other retrievers which may have a collapsed length of about 1 foot and extend to about 8 feet. Obviously, a 1 foot retriever extending to 8 feet requires at least eight telescoping sections.

The larger retrievers, i.e., those having an initial length of about 3 feet, generally use large diameter tubing, e.g., about 1 inch O.D. in the largest handle section, which allows use of various types of camming devices for locking the handle in any position. An exemplary form of handle structure using cam type locking devices is shown in U.S. Pat. No. 4,659,125.

While the camming structure is appropriate for larger retrievers, the smaller retrievers are generally constructed with a largest section having an outer diameter of no more than about 0.5 inch and the smallest section having an outer diameter of at least about 0.25 inch. Cam locking structures are difficult to implement in the smaller retrievers due to this reduced diameter.

Another form of handle assembly which is more practical for the smaller handles is one which relies solely on frictional engagement between the telescoping sections and does not use a positive type lock for holding the sections in a fixed position. One particular design forms each handle section with a uniform diameter except for a relatively short necked down (reduced diameter) portion at one end of each section. A pair of diametrically opposite small holes are formed at an opposite end of each section. Each inner section has an outer diameter that is less than an inner diameter of each immediately overlaying section by twice the thickness of one of a pair of bronze shims placed between the sections. Each of the shims has a punched dimple which fits into a respective one of the holes formed in the section to capture the shims in a fixed position at one end of the section. The shims form a tight, sliding relationship between adjacent sections with the bronze material acting as a bearing. Since the reduced diameter end cannot pass over the shims, the shims also function to prevent the sections from being pulled apart when the retriever handle is extended.

One problem with this small handle construction is that a golfer who has to use the retriever is often angry and will attempt to extend the telescopic handle with unnecessary force. As a result, the small dimple can shear away and allow the sections to separate and destroy the retriever. This problem is exacerbated in better quality retrievers made from thin wall, stainless steel tubing since the thin wall has a near knife edge and easily shears the bronze shim material.

Another problem with this small handle construction is that assembly of the handle using two opposing shims is awkward. Both shims must be held in tight juxtaposition on each handle section during assembly and each shim is separately positioned in the assembly orientation. Accordingly, it would be advantageous to provide a mechanism for small retriever handles which is relatively easy to assemble and has better holding power.

SUMMARY OF THE INVENTION

Among the several objects of the present invention may be noted the provision of an improved telescoping handle assembly; the provision of a telescoping handle assembly which simplifies the assembly process; and the provision of a telescoping handle assembly which has better resistance to separation. The above and other objects, features and advantages will be in part apparent and in part pointed out in the description to follow. In an illustrative embodiment, the telescoping handle of the present invention is formed of a plurality of telescoping sections with each section having an outer diameter which is slightly smaller than an inner diameter of an immediately overlaying section. Each section has one end formed with a necked down portion having an inner diameter which slides in abutting relationship on the outer surface of an immediately underlying section. An opposite end of each section is formed with a single axially extending closed end slot. A bronze sleeve fits around the section and has a radially inward directed tab portion extending over the axial extent of the sleeve. The tab portion is sized to fit the slot. In a preferred form, the tab portion is formed by bends in the sleeve and the sleeve is sized to fit about 270° around the handle section. The sleeve can be positioned on the handle and will stay in place without being held. During assembly, the sleeve can be pressed against the section surface to allow another section to be slid over the sleeve.

BRIEF DESCRIPTION OF THE DRAWINGS

For a better understanding of the present invention, reference may be had to the following detailed description taken in conjunction with the accompanying drawings in which:

FIG. 1 is simplified view of a golf ball retriever with which the present invention may be used;

FIG. 2 is a perspective view of one tubular section of the retriever of FIG. 1 showing use of the present invention;

FIG. 3 is an end view of a sleeve used in the present invention;

FIG. 4 is a perspective view of the sleeve of FIG. 3; and

FIG. 5 is a partial cross-sectional view of a joint in a telescoping rod using the present invention.

DETAILED DESCRIPTION OF THE INVENTION

FIG. 1 is a simplified illustration of a typical golf ball retriever 10 including a telescoping handle 12, a golf ball grasping member 14 and a hand grip 16. The member 14 may be constructed substantially as shown in the aforementioned U.S. Pat. No. 5,266,926. The handle is made up of a plurality of progressively smaller sections A–D, although it will be recognized that the number of sections can be varied as desired, within reasonable size and weight limits, to produce a retriever of different extended lengths. For the size of rod for which the invention is particularly directed, i.e., between about ½ inch and ¼ inch diameter, a typical length is about 8 feet using eight sections of about one foot in length each.

FIG. 2 is a perspective view of one of the sections A–D making up handle 12. The section, identified as 18, is a tube having a uniform inner and outer diameter between a first end 20 and a shoulder 22. At shoulder 22, the tube 18 is necked down to a smaller diameter forming an end portion 24. The axial length 26 of tube 18 may be about 10 inches and the axial length of end portion 24 may be about 1/16 inch. The difference in inside diameter at portion 24 may only be about 10–20 thousandths of an inch, which difference is determined by the thickness of the sleeve 30 illustrated in FIGS. 3 and 4 as will be discussed below.

The section 18, assuming to be equivalent to section B of FIG. 1, has an inside diameter sized to accept and pass over the section A and an outside diameter sized to slide into section C. The reduced diameter portion 24 fits snugly on section A without being so tight as to impede sliding motion of section A into section B. To prevent separation of the sections once assembled, the C-clip or sleeve 30 fits tightly about section 18 (different size sleeves 30 are used for each different diameter sections of handle 12) and is retained in place by a bend forming an axially extending raised element 32 which fits into a slot 34 in section 18. The element 32 is actually formed by multiple bends (at least three) in the strip material of sleeve 30 to form an element which protrudes radially inward from an arcuate plane of the sleeve. The phantom lines 36 in FIG. 2 indicate positioning of the sleeve 30 on section 18 with the element 32 fitting in slot 34.

FIG. 5 is a partial cross-sectional view of one joint between two sections of handle 12 showing how the reduced diameter portion 24 abuts sleeve 30 to prevent separation of the sections A and B. The sleeve 30 is held snugly between sections A and B forcing element 32 into slot 34 so that sleeve 30 cannot move axially. The extended axial length of element 32 provides sufficient strength to prevent the element 32 from being sheared away by repeated impact with the edges of slot 34. This construction assures that even with the thin wall stainless steel tubing used for the handle sections that the sleeve 30 will have sufficient strength to resist repeated contact between element 32 and the slot edges.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A holding mechanism for a telescopic handle comprising a plurality of telescoping hollow tubes characterized by relative sliding stiffness between each of the tubes and having a similar resistance to rotation, the holding mechanism comprising:

a one piece partial sleeve sized to fit snugly about a respective one of the telescoping tubes, said sleeve having a crimped portion extending radially inward over an axial extent of the sleeve intermediate opposite circumferential ends thereof;

said one of the tubes having an axially extending slot adjacent a first end thereof, said slot having axial and circumferential dimensions corresponding to said crimped portion of said sleeve for receiving said crimped portion when said sleeve is positioned on said one of the tubes;

another of the telescoping tubes positioned in sliding engagement over said one of the tubes and having one end terminating in a necked down portion having an inner diameter larger than an outer diameter of said one of the tubes and smaller than a diameter of said sleeve when said sleeve is positioned on said one of the tubes whereby said one end of said another of the tubes cannot pass over said sleeve on said one of the tubes.

2. The holding mechanism of claim 1 wherein said sleeve extends at least about 270° circumferentially.

3. The holding mechanism of claim 1 wherein said sleeve is formed of a bronze material.

4. The holding mechanism of claim 1 wherein said crimped portion is formed by bending a section of the sleeve out of an arcuate plane of the sleeve.

* * * * *